US009339126B2

(12) United States Patent
Turner

(10) Patent No.: US 9,339,126 B2
(45) Date of Patent: May 17, 2016

(54) AIR CATCHING APPARATUS FOR A REFRIGERATED CABINET

(71) Applicant: David Turner, Burnley (GB)

(72) Inventor: David Turner, Burnley (GB)

( * ) Notice: Subject to any disclaimer, the term of this patent is extended or adjusted under 35 U.S.C. 154(b) by 259 days.

(21) Appl. No.: 13/621,772

(22) Filed: Sep. 17, 2012

(65) Prior Publication Data

US 2013/0152616 A1 Jun. 20, 2013

(30) Foreign Application Priority Data

Jan. 15, 2011 (GB) ..... 1200599.7
Sep. 15, 2011 (GB) ..... 1115924.1

(51) Int. Cl.
*A47F 3/04* (2006.01)

(52) U.S. Cl.
CPC ..... *A47F 3/0439* (2013.01); *A47F 3/0447* (2013.01); *A47F 3/0469* (2013.01)

(58) Field of Classification Search
CPC ... A47F 3/0447; A47F 3/0443; A47F 3/0439; A47F 3/0469; F25D 23/023; F25D 17/046; F25D 2317/0651; F25D 2323/00264; F25D 2323/0021
USPC ..... 62/256, 255, 246, 253, 404, 407, 408; 454/188–193; 312/116
See application file for complete search history.

(56) References Cited

U.S. PATENT DOCUMENTS 3,229,475 A * 1/1966 Balk et al. ..... 62/256
3,263,745 A * 8/1966 Henry ..... 165/48.1
3,304,736 A * 2/1967 Brennan et al. ..... 62/176.1
3,365,908 A * 1/1968 MacMaster ..... 62/256
3,478,535 A 11/1969 Perez et al.
3,531,945 A * 10/1970 Brennan ..... 62/234
3,719,408 A * 3/1973 Fullington et al. ..... 312/236
4,326,385 A * 4/1982 Ibrahim ..... 62/82
4,404,816 A * 9/1983 Ibrahim et al. ..... 62/282
4,449,374 A * 5/1984 Ibrahim ..... 62/81
4,938,034 A * 7/1990 Rosanio et al. ..... 62/256
5,251,608 A * 10/1993 Cote ..... 126/299 D
5,475,987 A * 12/1995 McGovern ..... 62/256
5,761,922 A * 6/1998 Tamai et al. ..... 62/256
7,681,409 B2 * 3/2010 Alahyari et al. ..... 62/255
2004/0069002 A1 4/2004 Chuang et al.
2007/0012059 A1 * 1/2007 Roche et al. ..... 62/256
2007/0251253 A1 * 11/2007 Alahyari et al. ..... 62/256
2009/0215381 A1 * 8/2009 Swofford ..... 454/193

FOREIGN PATENT DOCUMENTS

DE 29622354 U1 5/1997
EP 0441357 A2 8/1991
EP 0441358 A2 8/1991
GB 2295221 A * 5/1996 ..... A47F 3/04
NL 1028973 A 11/2006

* cited by examiner

*Primary Examiner* — Cassey D Bauer
*Assistant Examiner* — Kirstin Oswald
(74) *Attorney, Agent, or Firm* — Levine Mandelbaum PLLC

(57) ABSTRACT

A refrigerated air curtain redirection unit can be retro fitted to the front base of a an existing reach-in commercial open-display refrigerated cabinet, or provided as original built-in equipment for a newly manufactured cabinet to reduce refrigerated air spillage. The unit has a body part that protrudes outwardly of the open frontage of the cabinet at an upward angle and there is an inwardly curved part at its top region whereby an air vortex is formed that acts to draw air from the curtain at its base into an air duct of the cabinet.

11 Claims, 6 Drawing Sheets

AIR CATCHING APPARATUS FOR A REFRIGERATED CABINET

BACKGROUND OF THE INVENTION

The present invention relates to air-catching apparatus to limit air spillage from a refrigerated air curtain at the open frontage of a commercial refrigerated reach-in open-display cabinet. More particularly, the present invention relates to a system and method to prevent the refrigerated air curtain from spilling out of the base of a reach-in commercial open-display refrigerated cabinet. Such refrigerated cabinets are widely used to display goods that need to be kept cold but which are accessible by reaching in through an open frontage of the cabinet. In order to keep the goods cold despite the open frontage, a curtain of refrigerated air is directed from the top of the frontage down to its base from where it is re-circulated.

Over recent years, concerns over energy production have become ever more relevant as stocks of fossil fuels are depleting worldwide. Production of electricity is central to these concerns and various ways in which electricity is used have been investigated. In addition to the environmental concerns, the increasing costs of producing electricity have been born by the end user. Ways in which the electricity already produced is used and conserved is at the forefront of current consumer thinking with a view to reducing energy costs. With this in mind, a need for a device to credibly/affordably reduce the waste energy from commercial refrigeration units exists.

Although there are many ways available in the current market place to purchase energy efficient refrigeration systems, the cost vs. saving can in most cases be difficult to justify. In addition, even newly manufactured units encounter huge losses of waste refrigerated air by way of design. Therefore the need for additional elements to add to existing refrigerated units and likewise new units is required.

SUMMARY OF THE INVENTION

According to the invention therefore there is provided air-catching apparatus to limit air spillage from a refrigerated air curtain at the open frontage of a commercial refrigerated reach-in open-display cabinet, wherein the apparatus comprises an air-catching unit at the base of said frontage which protrudes at an angle outwards at the frontage, characterised in that the unit has a top region that is curved inwardly whereby an air vortex is created at said base which acts to direct air from the curtain into the cabinet.

In more detail, with the present invention a number of units can be placed at the base of a reach-in refrigerated commercial open-display cabinet. The air-catching apparatus can be designed in such a way that each unit protrudes on an angle and outwards finishing at the top with a 180 degree or lesser curve from the refrigerated cabinet, thus covering the entire length of the base of the cabinet. The vortex method captures and then redirects a large percentage of previously wasted refrigerated air into the cabinet's air-recovery ducts, therefore resulting in substantially reduced energy costs and $CO_2$ production.

Thus the curved top region of the air-catching unit may have a part-circular curvature.

The air-catching unit may be elongate with a fixing part along its bottom region, a flat body part between the bottom region and the curved top region, and transverse end parts at ends of the body part, the body part being at an angle to the fixing part.

The invention also provides a refrigerated cabinet having an open frontage, internal shelving or decking, means for directing a curtain of refrigerated air from the top of the frontage down to the base thereof, air-recovery ducts in the cabinet to receive air from the said base, and an air-catching unit as described above fixed along said base whereby the said air vortex acts to direct air from the curtain to the said ducts and thereby reduces spillage of such air. The air-catching unit may be retrofitted to the cabinet so that the unit protrudes outwardly from the frontage. The aforesaid body part of the air-catching unit and the said curved region may protrude wholly from the frontage, and there may be multiple air-catching units extending along the entire length of the base.

Below is a description of a refrigerated cabinet with an air-catching unit in accordance with one form of the invention, making reference to the accompanying drawings, FIGS. 2-6. FIG. 1 shows a conventional cabinet.

The air-catching unit shown in the FIGS. 2-6 can be manufactured from many different kinds of material, including metal (and derivatives of such), plastic and glass. The unit can be fitted retrospectively onto existing (in use) reach-in commercial open-display refrigerated cabinets of any size or design. In addition to this the unit can be pre-manufactured onto new reach-in commercial open-display refrigerated cabinets as shown in FIG. 4.

DESCRIPTION OF THE PREFERRED EMBODIMENT

Figure 1:
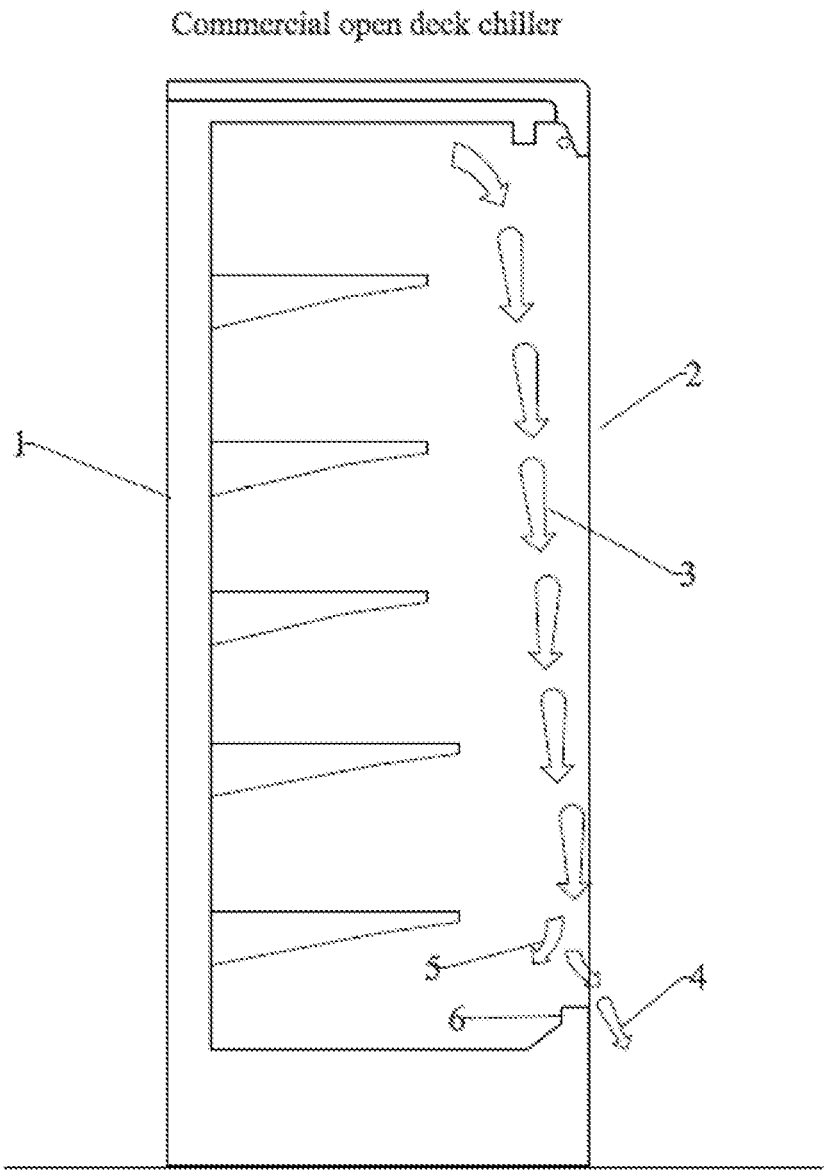
FIG. 1 is an upright side sectional view of a standard reach-in commercial open-display refrigerated cabinet showing flow of refrigerated air.

Referring to FIG. 1, this shows a conventional commercial refrigerated cabinet 1 or chiller having an upright open frontage 2 providing reach-in access to deck space inside the cabinet. Cold air apparatus is used to generate a flow 3 of refrigerated air down from the top of the frontage 2 to its base to establish a refrigerated air curtain over the frontage 2, as indicated by the arrows. At the base of the frontage there is an upstanding lip 4. Cold air flow 5 from the curtain falls inwardly of the lip 4 into an air recovery duct (not shown). In practice, a proportion 6 of the cold air flow spills over the lip forwardly thereof and escapes to the environment. Arrows in FIG. 1 clearly highlight the current airflow loss. This can be as high as 40% of the refrigerated air.

Figure 2:
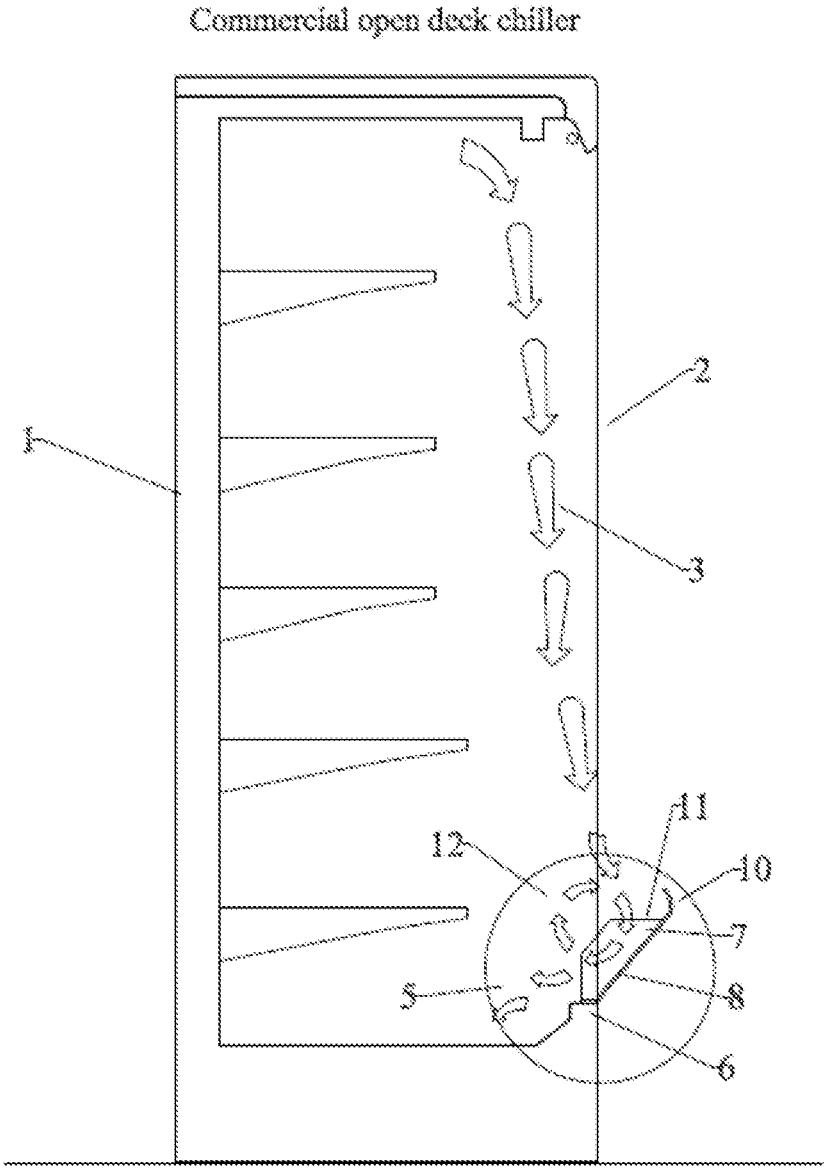
FIG. 2 is an upright side sectional view of a standard reach-in commercial open-display refrigerated cabinet like FIG. 1, with the retro-fitted air-catching unit.

FIG. 2 shows an air-curtain redirection unit 7 fixed onto a reach-in commercial open-display refrigerated cabinet 1 of the standard kind shown in FIG. 1. As shown, the unit is fixed to the lip. The unit 7 is elongate and has a flat main body part 8, a flat base part 9 (see FIG. 3) extending at an angle to the body part 8 at the base edge region of the unit 7, a curved top part 10 at the top region of the unit 7, and end plates 11 transverse to the body part 8 at the ends of the unit 7. The unit 7 is fixed to the lip 6 at the base part 9 which lies on top of the lip 6 in level disposition with the body part 8 extending upwardly and outwardly of the cabinet frontage and the top part 10 curved inwardly towards the frontage 2. As shown the body part 8 and the top part 10 protrude wholly outside the frontage 2.

Figure 3:
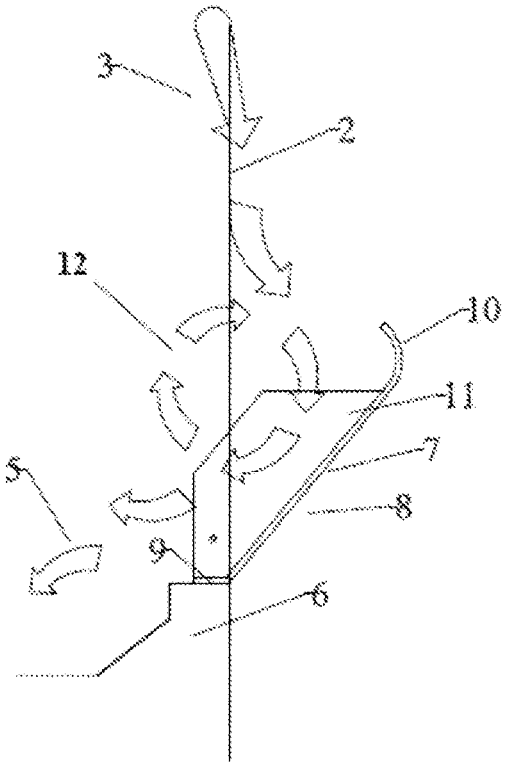
FIG. 3 is an enlarged view of the fixed air-catching unit shown in FIG. 2.

FIGS. 2 and 3 show the airflow 3,5 and the vortex method created by the air redirection unit 7 clearly showing the potential for substantially reducing refrigerated air loss. That is, the cold air from the curtain swirls within the space defined between the body part 8, the top part 10 and the end plates 11 to form a vortex 12 and this has the effect of drawing the air inwardly into the cabinet thereby reducing spillage forwardly of the frontage to escape into the environment.

Figure 4:
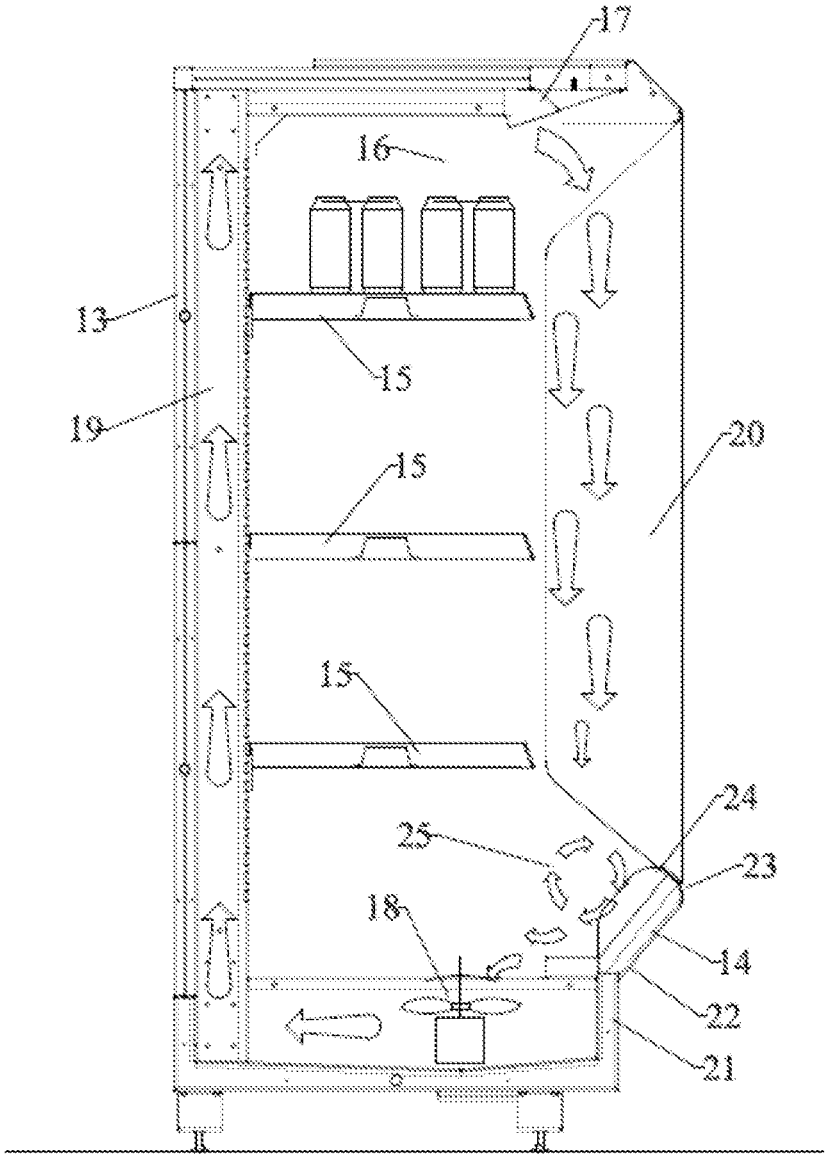
FIG. 4 shows a side view of a newly manufactured cabinet with the air-catching unit built in as original equipment.

FIGS. 2 and 3 relate to a retro-fitted air-catching unit on a standard cabinet 1. FIG. 4 shows a cabinet 13 with an air-catching unit 14 fitted as original equipment. As shown, the cabinet 13 has a number of shelves 15 or decks for goods 16 to be chilled. Also, the cabinet has a refrigerated air duct system which directs air downwardly from an upper outlet 17 to a base intake 18 from where it is drawn in and directed to a recirculation channel 19. The refrigerated air forms a curtain across the open frontage 20 of the cabinet 13. At the base of the frontage 20 there is an upright lip 21 to which is attached an air-catching unit 14 with a flat outwardly and upwardly protruding body part 22, an inwardly curved top part 23, and upright end plates 24 transverse to the body part 22. An air flow vortex 25 is defined, as shown, in like manner to FIGS. 2 and 3. This vortex 25 substantially reduces the refrigerated air loss in comparison to the standard arrangement of FIG. 1.

Figure 5:
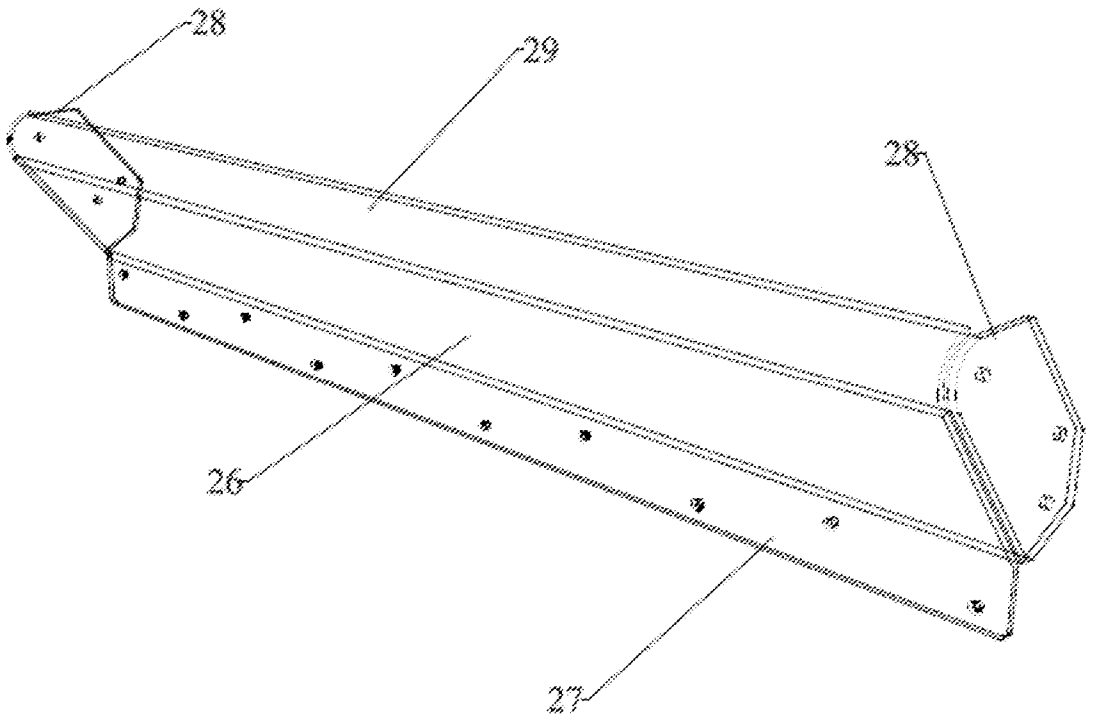
FIG. 5 is a perspective view of a modified form of a retro-fit air-catching unit.

FIG. 5 shows a stand-alone retro-fit unit which is a modified version of that shown in FIGS. 2 and 3. It is elongate and has a flat main body part 26, a flat base part 27, end plates 28 transverse to the body part 26, and a curved top part 29. The end plates 28 have different profiles from those of FIGS. 2 and 3, and the base part 27 is at a different angle to the body part 26 whereby the base part 27 is fixed in upright disposition to the lip 6 in order that the body part 26 extends upwards and outwards with the top part 29 curved inwardly in like manner to the arrangement shown in FIGS. 2 and 3, i.e., so as to give rise to the same air vortex effect.

Figure 6:
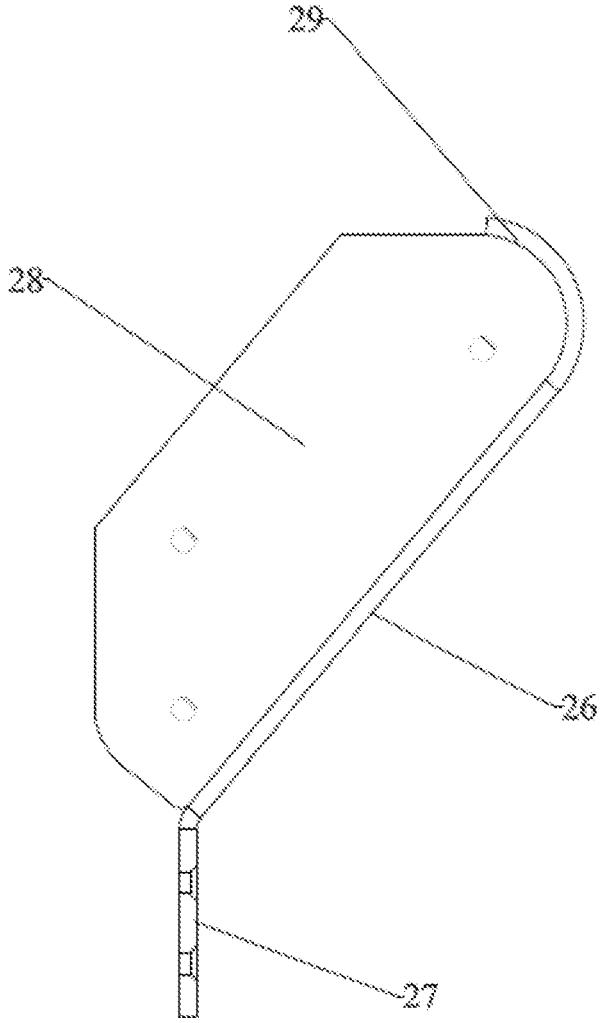
FIG. 6 is a side view of the unit of FIG. 5.

The unit of FIGS. 5 and 6 can be fixed alone or end to end with other like units so as to cover the entire length of the base of any size of reach-in commercial open-display refrigerated cabinets, thus closing all available air curtain spill space.

The invention is capable of other embodiments and it is to be understood that the phraseology terminology employed herein are for the purpose of description and should not be regarded as limiting. As such, those skilled in the art will appreciate that the conception, upon which this disclosure is based, may readily be utilized as the basis for the designing of other structures for carrying out the purpose of the present invention. It is important, therefore, that the claims be regarded as including such equivalent constructions insofar as they do not depart from the spirit and scope of the present invention. To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

With the arrangements of FIGS. 2 to 6 advantages arise as follows:

The refrigerated air curtain redirection unit, for use on reach-in commercial open-display refrigerated cabinets, creates a vortex system to reduce air build up and therefore overspill.

The unit gives, a method of capturing refrigerated air likely to spill from the base of the open cabinet frontage.

The unit acts to redirect the refrigerated air curtain into the air recovery ducts of the cabinet.

The unit acts to reduce the overall energy consumption of a reach-in commercial refrigerated display cabinet by reducing the refrigerated air curtain spillage.

A refrigerated air curtain redirection unit can be retrofitted onto or built as original equipment into an existing cabinet design.

The invention claimed is:

1. A refrigerated reach-in open display cabinet comprising: an air catching apparatus to limit air spillage from a refrigerated air curtain at an open frontage of the refrigerated reach-in open-display cabinet, said open frontage having a base, wherein the air-catching apparatus comprises an air-catching unit at the base of said open frontage which protrudes at an angle outwards at the open frontage, wherein the air-catching unit comprises a surface arranged, to extend outwardly and upwardly of the open frontage and to face the open frontage, wherein the surface has a top region that is curved inwardly whereby an air vortex is created at said base which acts to direct air from the refrigerated air curtain into the cabinet.

2. The refrigerated reach-in open display cabinet of claim 1 further comprising: wherein the curved top region of the air-catching unit has a part-circular curvature.

3. The refrigerated reach-in open display cabinet of claim 1 further comprising: wherein the air-catching unit is elongate and has a fixing part along its bottom region, a flat body part between the bottom region and the curved top region, and transverse end parts at ends of the body part, the body part being at an angle to the fixing part.

4. A refrigerated reach-in open display cabinet having an open frontage, internal shelving or decking, an outlet for directing a curtain of refrigerated air from the top of the open frontage down to a base thereof, air-recovery ducts in the refrigerated reach-in open display cabinet to receive air from the said base, and an air-catching unit at the base of said open frontage which protrudes at an angle outwards at the open frontage and comprises a surface arranged, to extend outwardly and upwardly of the open frontage and to face the open frontage, the surface having a top region that is curved inwardly whereby an air vortex is created at said base which acts to direct air from the curtain into the cabinet, said air catching unit being fixed along said base whereby the said air vortex acts to direct air from the curtain to the said ducts and thereby reduces spillage of such air.

5. The refrigerated reach-in open display cabinet of claim 4 further comprising: wherein the air-catching unit is retrofitted to the cabinet and the unit protrudes outwardly from the frontage.

6. The refrigerated reach-in open display cabinet of claim 5 further comprising:

wherein the body part and the curved region protrude wholly from the frontage.

7. The refrigerated reach-in open display cabinet of claim 5 further comprising: wherein the air-catching unit extends along the entire length of the base.

8. The refrigerated reach-in open display cabinet of claim 6 further comprising: wherein the air-catching unit extends along the entire length of the base.

9. The refrigerated reach-in open display cabinet of claim 4 further comprising: wherein the air-catching unit extends along the entire length of the base.

10. The refrigerated reach-in open display cabinet of claim 4 further comprising: wherein the curved top region of the air-catching unit has a part-circular curvature.

11. The refrigerated reach-in open display cabinet of claim 4 further comprising: wherein the air-catching unit is elongate and has a fixing part along its bottom region, a flat body part between the bottom region and the curved top region, and transverse end parts at ends of the body part, the body part being at an angle to the fixing part.

* * * * *